US005232622A

United States Patent [19]

Jones et al.

[11] Patent Number: 5,232,622

[45] Date of Patent: Aug. 3, 1993

[54] CHLORINE-FREE MACHINE DISHWASHING

[75] Inventors: Charles E. Jones, Yardley; Andrea C. Keenan, Plymouth Meeting; George M. Lein, Chalfont, all of Pa.

[73] Assignee: Rohm and Haas Company, Philadelphia, Pa.

[21] Appl. No.: 746,077

[22] Filed: Aug. 12, 1991

Related U.S. Application Data

[63] Continuation of Ser. No. 541,239, Jun. 20, 1990, abandoned.

[51] Int. Cl.[5] ..... C11D 3/37; C11D 3/04; C11D 3/12; B08B 3/08

[52] U.S. Cl. ..... 252/174.24; 252/135; 252/156; 252/174.14; 252/174.25; 252/DIG. 2; 134/25.2

[58] Field of Search ..... 252/135, 156, 174.14, 252/174.25, DIG. 2, 174.24; 134/25.2

[56] References Cited

U.S. PATENT DOCUMENTS

| | | | |
|---|---|---|---|
| 4,347,168 | 8/1982 | Murphy et al. | 252/547 |
| 4,457,856 | 7/1984 | Mitchell et al. | 252/166 |
| 4,687,592 | 8/1987 | Collins et al. | 252/99 |
| 4,689,167 | 8/1987 | Collins et al. | 252/95 |
| 4,906,397 | 3/1990 | Leighton et al. | 252/174.24 |

*Primary Examiner*—Paul Lieberman
*Assistant Examiner*—Erin M. Higgins
*Attorney, Agent, or Firm*—James G. Vouros

[57] ABSTRACT

This invention relates to chlorine-free machine dishwashing detergent compositions that provide cleaning as effective as conventional chlorine containing machine dishwashing compositions. More specifically, this invention relates to dishwashing detergent compositions containing copolymers formed from maleic acid, maleic anhydride, or salts thereof, and a copolymerizable hydrophobic monomer, oligomer or polymer, containing from 4 to 20 carbon atoms. Another aspect of the invention is a chlorine-free machine dishwashing detergent containing low levels of, or no phosphate.

18 Claims, No Drawings

CHLORINE-FREE MACHINE DISHWASHING

RELATED APPLICATIONS

This application is a continuation of U.S. Ser. No. 07/541,239, filed Jun. 20, 1990, now abandoned.

FIELD OF THE INVENTION

This invention relates to chlorine-free machine dishwashing detergent compositions that provide cleaning as effective as conventional chlorine containing machine dishwashing compositions. More specifically, this invention relates to dishwashing detergent compositions containing copolymers formed from maleic acid, maleic anhydride, or salts thereof, and a copolymerizable hydrophobic monomer, oligomer or polymer, containing from 4 to 20 carbon atoms. Another aspect of the invention is a chlorine-free machine dishwashing detergent containing low levels of, or no phosphate.

BACKGROUND OF THE INVENTION

Conventional machine dishwashing detergents generally contain an available chlorine releasing agent and a polyphosphate builder as critical components. The chlorine agent, such as 2–3% sodium dichloroisocyanurate, has generally been found to be necessary to achieve spot free glassware. The polyphosphate, typically sodium tripolyphosphate, seemed vitally important to provide adequate soil removal, inhibit soil redeposition and prevent hard water salt deposits on glassware and other utensils.

The necessity of incorporating an available chlorine releasing agent in a detergent has many drawbacks. One obvious one is the objectionable chlorine like odor released during the hot washing operation. Another is the significant additional cost of the formulation as the desirable available chlorine releasing agents are relatively expensive. A more important drawback is the inherent instability of available chlorine releasing agents when formulated into detergent compositions. The detergent will continually lose available chlorine during storage, resulting in limited shelf-stability. Therefore, it is common practice to add extra chlorine agent at the time of manufacture to compensate for loss during storage. This adds to the cost of the product and merely extends the shelf-life which is still limited.

A major, and in the case of liquid detergent compositions, the most serious limitation of having a chlorine agent in the formulation is the incompatibility of these strong oxidizing agents with organic additives, particularly low-foaming surfactants. The presence of a low-foaming surfactant is desirable because it can add significantly to the performance of the detergent by providing increased cleaning action and preventing soil redeposition. Even more importantly, when soil loads are high, some low-foam surfactants will defoam the protein food soil stabilized foam which markedly reduces the mechanical efficiency of the wash spray. The reactions of oxidizing chlorine agent and the surfactant will be evidenced by an increased rate of loss of available chlorine and a gradual loss of surfactant performance, particularly in food soil defoaming capability.

In granular or powdered formulations, the incompatibility results in short shelf-life. In the liquid or slurry type of formulations, the reaction of chlorine agent and low-foam surfactant in solution is rapid enough to prevent any attempt to incorporate low-foaming surfactants into the formulation. Therefore, the performance of liquid (or gel) machine dishwashing detergents is noticeably inferior to granular or powder low-foam surfactant containing dishwasher detergents.

Prior attempts to avoid the problems associated with including available chlorine releasing agents have been primarily in the direction of using milder oxidizing agents, such as the "oxygen bleaches"; peroxides, perborates and persulfates. However, these agents do not produce the spot free glassware achieved when the chlorine bleaches are used.

None of the prior art teaches the elimination of chlorine agents by the use of hydrophobe/maleic acid copolymers in machine dishwashing detergent compositions.

The desirability of avoiding phosphates in detergents is well recognized. Phosphorus based compounds when present in lakes, rivers, and bays, serve as nutrients for algae growth, resulting in the deterioration of water quality. Environmentally acceptable detergents are those free of polyphosphates and other sources of phosphorus. Even though polyphosphates have been reduced or eliminated from household laundry detergents in many countries, machine dishwashing detergents have always been exempted from the phosphate ban on the basis of studies by machine dishwashing detergent manufactures. These studies indicate polyphosphates are necessary for acceptable washing performance.

Development of machine dishwashing detergents using substitutes for phosphate containing compounds has been addressed in the patent literature. U.S. Pat. No. 4,203,858 teaches using a low molecular weight polyacrylic acid in a phosphate free machine dishwashing composition. U.S. Pat. No. 4,608,188 teaches the use of a maleic acid/acrylic acid copolymer. Our testing demonstrates these polymers do not give the superior performance of the hydrophobe containing maleic acid copolymer of the present invention.

U.S. Pat. No. 3,764,559 teaches the use of detergent compositions containing maleic anhydride polymers as a means to eliminate phosphates. The polymers used in this patent are maleic anhydride copolymerized with vinyl acetate, utilized at a broad level of 5% to 65%, and a more preferred range of 20% to 50% by weight of the copolymer.

U.S. Pat. No. 4,102,799 teaches the use of detergents essentially free of inorganic phosphates. The detergents were shown to have improved effects on overglaze through the use of citrate substitution. However, these detergents also contains organic phosphorus compounds in the form of phosphonates, so the compositions are not truly phosphorus free. In addition, the detergent compositions of U.S. Pat. No. 4,102,799 contain from about 0.5 to 5 percent by weight of a bleaching agent.

U.S. Pat. No. 4,182,684 teaches phosphate free machine dishwashing detergent compositions by using from 5 to 90 percent by weight of a polymeric compound. The detergent composition disclosed in U.S. Pat. No. 4,182,684 also contains a chlorine containing compound, providing from 0.5 to 2 percent by weight available chlorine.

Other patents which include polymeric materials are European Patent 132,792, German Patent DE 3627773-A, and UK Patent Application GB 2,203,163-A. EP 132,792 teaches certain cleaning compositions for washing dishes in automatic dishwashers. The compositions contain from 1 to 8 weight percent of a polycarboxylic acid having molecular weight of 12,000 to 40,000. In addition, the detergent contains alkaline surfactants and standard additives such as bleaching agents, biocides, perfumes, foaming-inhibitors, and/or solubilizers. The polymer can be polyacrylic or polymethacrylic acid or polymers of maleic acid or fumaric acid and ethylene or propylene.

German Patent DE 3627773-A teaches a phosphate free detergent composition utilizing a crystalline alkali layered silicate with a polymeric material. The composition also makes use of a defoaming surfactant and an available chlorine source.

GB 2203163-A teaches the use of a polyacrylic acid and a polyhydroxy acrylic acid in a liquid dishwashing composition. However, this dishwashing detergent composition also requires the use of 3–15% by weight sodium hypochlorite and 0.4 to 6 percent by weight of a chlorine-resistant phosphonate or organic phosphate.

Some patents also exist for phosphate-free detergent compositions which are liquids or pastes, such as Canadian Patent 1,158,522, UK Patent Application GB 2,210,055 and Canadian Patent 1,058,040. Canadian Patent 1,158,522 describes phosphate-free liquid dishwashing compositions containing a partially neutralized aminocarboxylic acid, a water soluble salt of a nitrogen-free linear polymer containing carboxyl groups and a low-foaming nonionic surfactant. Canadian Patent 1,158,522 utilizes environmentally unacceptable nitrogen containing aminocarboxylic salts, such as nitrilotriacetic acid or ethylene diamine tetraacetic acid.

GB 2,210,055 describes the use of polymer (polyacrylate) with zeolite to achieve performance. This composition also contains a chlorine source. Since the normal stabilizers are not chlorine stable, the composition of the GB 2,210,055 Application tends to stratify on standing. Canadian Patent 1,058,040 also teaches the use of water insoluble zeolites for the builder. When used as dishwashing detergents, because the zeolite is insoluble, deposits form on the glasses in the course of the cleaning operation.

Several other patents make use of polymeric additives in dishwashing detergent compositions, but they also teach the use of phosphates and chlorine. These patents are DE 2,304,404-A, EP 271,992-A, and UK Patent Application GB 2,163,447-A.

Because of the effective performance of the chlorine free detergent composition of this invention, chlorine sensitive materials can now be added to the detergent composition.

SUMMARY OF THE INVENTION

The object of the present invention is to provide a chlorine-free dishwashing detergent. It is a further object of the invention to provide a chlorine-free, phosphate-free dishwasher detergent. The objects of this invention are accomplished by including in a detergent composition a copolymer containing as polymerized units maleic acid, maleic anhydride, or the salts thereof, and a hydrophobe, wherein the hydrophobe is a compound containing from 4 to 20 carbon atoms.

DETAILED DESCRIPTION OF THE INVENTION

Chlorine-free machine dishwashing detergents can be formulated by the inclusion of copolymers containing as polymerized units maleic acid, maleic anhydride, or the salts thereof, and a hydrophobe. "Hydrophobe," as used herein, refers to a monomer, oligomer, or polymer, which is copolymerized with monomers, oligomers, or polymers of maleic acid, maleic anhydride, or the salts thereof, and is more hydrophobic than maleic acid, maleic anhydride, or the salts thereof. Preferably, the hydrophobe contains at least 4 carbon atoms and more preferably from 4 to 20 carbon atoms. The hydrophobe can be at least one monomer selected from the group of an alkane, alkene, diene, alkyne or an aromatic compound. Examples of suitable hydrophobes include isobutylene, diisobutylene, styrene, decene and eicosene. The most preferred hydrophobe is diisobutylene. The water soluble salts of the copolymers, such as for example the alkali metal salts or the ammonium or substituted ammonium salts thereof, can also be used.

These copolymers can be prepared by conventional methods of polymerization well known to those skilled in the art. The amount of maleic acid or anhydride contained in the copolymer is from about 20 to 75 percent, more preferably from about 25 to 70 percent based on the weight of the copolymer. The amount of hydrophobe contained in the copolymer is about 25 to 80 percent, more preferably from about 30 to 75 percent based on the weight of the copolymer. Since the copolymer must be water soluble, the amount of hydrophobe contained in the copolymer is dependent upon the hydrophobe selected and the water solubility of the resultant copolymer.

It has been found that the performance of the copolymer used in this application is not dependent upon its molecular weight, provided that the molecular weight of the copolymer does not adversely affect its water solubility.

The concentration of copolymer in a detergent composition is from about 0.5 to 10 percent by weight of the detergent composition and more preferably from about 2 to 7 percent by weight. The concentration of the copolymer in the detergent composition is dependent on the amount of other additives in the detergent composition which have an impact on the desired performance characteristics. For example, if a phosphate containing compound is present in the detergent composition, the effective amount of copolymer necessary to achieve the desired performance may be lower than if no phosphate containing compound is present.

The detergent composition of this invention can be in the form of either a powder or liquid. As used herein, "liquid" also refers to a gel or a slurry. The detergent composition of this invention may include, except for chlorine releasing agents, conventional machine dishwashing detergent additives well known to those skilled in the art, in conventional use amounts. For example, the detergent composition of this invention may contain an alkali metal silicate at a concentration of from 0 to about 50 percent, more preferably from about 1 to 10 percent by weight of the detergent composition. The alkali metal silicates used in the composition of the current invention can be a metasilicate, designated as 1:1 $M_2O:SiO_2$ silicates to low $M_2O:SiO_2$ silicates such as 3.2:1 silicates, where $M_2O$ represents the alkali metal oxide portion of the silicate. The more preferred alkali metal silicates are the sodium silicates.

While the alkali metal silicates are an optional component of the present invention, highly alkaline dishwashing detergents containing no silicates may attack aluminum pots and pans and other metal utensils. Therefore, silicates are beneficial when corrosion inhibition of metal parts is desired.

The detergent composition of this invention may optionally include a builder. The level of builder can be from 0 to about 90 percent and more preferably from 20 to 90 percent by weight of the detergent composition. However, the builder concentration is dependent on whether the detergent is a liquid or a powder. Generally, a liquid composition will require less builder than a powder composition. By way of example, builders which may be employed in combination with the copolymers of the present invention include water soluble inorganic builder salts such as alkali metal polyphosphates, i.e., the tripolyphosphates and pyrophosphates, alkali metal carbonates, borates, bicarbonates, and hydroxides and water soluble organic builders such as citrates, polycarboxylates and carboxylates. Also, zeolite may be added as a builder in amounts from 0 to about 40 percent, and more preferably from about 20 to 40 percent by weight.

Inert diluents, such as alkali metal chlorides, sulfates, nitrates, nitrites and the like, may also be used in the detergent composition. Examples of such diluents are sodium or potassium chloride, sodium or potassium sulfate, sodium or potassium nitrite, and the like. In addition, if the detergent composition is in the liquid form, water can be used as a diluent. The amount of diluent used is generally an amount to bring the total amount of the additives in the detergent composition up to 100% by weight.

Although optional, the detergent composition of this invention will generally contain a water soluble detergent surfactant. Any water soluble anionic, nonionic, zwitterionic, amphoteric surfactant or combination thereof can be employed. The quantity of surfactant used in the detergent formulation will depend on the surfactant chosen and will generally be from about 0 to about 10 percent and more preferably from about 1 to about 5 percent by weight of the detergent composition.

Examples of suitable anionic surfactants include soaps such as the salts of fatty acids containing about 9 to 20 carbon atoms, e.g. salts of fatty acids derived from coconut oil and tallow; alkyl benzene sulfonates-particularly linear alkyl benzene sulfonates in which the alkyl group contains from 10 to 16 carbon atoms; alcohol sulfates; ethoxylated alcohol sulfates; hydroxy alkyl sulfonates; alkenyl and alkyl sulfates and sulfonates; monoglyceride sulfates; acid condensates of fatty acid chlorides with hydroxy alkyl sulfonates and the like.

Examples of suitable nonionic surfactants include alkylene oxide (e.g. ethylene oxide) condensates of mono and polyhydroxy alcohols, alkyl phenols, fatty acid amides, and fatty amines; amine oxides; sugar derivatives such as sucrose monopalmitate; long chain tertiary phosphine oxides; dialkyl sulfoxides; fatty acid amides, (e.g., mono or diethanol amides of fatty acids containing 10 to 18 carbon atoms), and the like.

Examples of suitable zwitterionic surfactants include derivatives of aliphatic quaternary ammonium compounds such as 3-(N,N-dimethyl-N-hexadecyl ammonio)-propane-1-sulfonate and 3(N,N-dimethyl-N-hexadecyl ammonio)-2propane-1-sulfonate.

Examples of suitable amphoteric surfactants include betaines, sulfobetaines and fatty acid imidazole carboxylates and sulfonates.

Because of the absence of chlorine in the detergent composition, chlorine sensitive surfactants, such as defoaming alkoxylated surfactants, can be used. These surfactants not only offer the defoaming feature, but also enhance the sheeting action of the water from the ware.

The detergent may also contain up to about 5 percent by weight of conventional adjuvants such as perfumes, colorants and bacterial agents. When the detergent composition is the liquid form, from 0 to 5 percent by weight of stabilizers or viscosity modifiers, such as clays and polymeric thickeners, can be added. Prior to this invention, the addition of polymeric or organic stabilizers and thickeners in a liquid composition was difficult because of the interaction between the stabilizers and thickeners and the chlorine. Generally, no stabilizer or thickener was used to disperse the solid phase, leading to stratification or setting of the solids to produce a hard pack at the bottom of the container. Because of the effective performance of the detergent composition of this invention in the absence of chlorine, stabilizers or viscosity modifiers can be used effectively.

The detergent composition of this invention is used in machine dishwashers as an aqueous solution at a concentration of about 0.2 to 1.5 percent, more preferably from about 0.4 to 1 percent by weight of the detergent. The water temperature during the washing process should be about 80° F. to 140° F. and more preferably from about 100° F. to 125° F.

Test Method

The dishwashing tests were performed using a modified version of A.S.T.M. method D 3556-85, *Standard Test Method for Deposition on Glassware During Mechanical Dishwashing*. This test method covers a procedure for measuring performance of household automatic dishwashing detergents in terms of the buildup of spots and film on glassware. Glass tumblers were given multiple cycles in a dishwasher, in the presence of food soils, and the levels of spotting and filming allowed by the detergents under test were compared visually.

A Kenmore dishwashing machine was used to perform the washing tests. The bottom rack of the dishwasher was randomly loaded with 10–12 dinner plates and the top rack was randomly loaded with several beakers and cups. Four new 10 ounce tumblers were placed randomly on the top racks as the test glasses. Soil used in the test was a mixture of 80% Parkay Margarine and 20% Carnation Non-fat Dry milk. The amount of soil used for each test varied, but was usually 40–60 grams for the first wash.

When a test was ready to be started, the desired amount of soil was smeared across the four plates on the bottom rack, the detergent for the first cycle was placed in the detergent dispenser cup, and the machine was started. The dishwashing machines had a short and a long cycle. The long cycle, or normal wash, consisted of a wash, a rinse, a second wash, two more rinses, and then a drying cycle. The short cycle, or light wash, consisted of a wash, two rinses and the drying cycle. During the normal wash, at the start of the second wash (about twelve minutes into a normal cycle), the machine was occasionally opened and a second detergent aliquot added. This was not always the case. Soil was not added when a second detergent dose was added. The machine was then allowed to run the full cycle including the drying time.

When the drying cycle was completed, the door was opened and the four glasses were removed and evaluated for filming and spotting. The test glasses were evaluated by placing them in light box equipped with a fluorescence light. The glasses were ranked according to the following scale:

| Filming | | Spotting | |
|---|---|---|---|
| 0 | No film | 0 | No spots |
| 1 | Barely perceptible | 1 | Random |
| 2 | Slight | 2 | ¼ of glass |
| 3 | Moderate | 3 | ½ of glass |
| 4 | Heavy | 4 | Complete spotting |

An average filming and spotting rating was derived from the individual ratings by adding all the ratings for each glass per cycle, dividing by the number of glasses, then multiplying times the number of cycles. This numerical rating gave a good indication of the overall performance for each detergent tested. It was also noted if streaking existed or calcium deposits were present.

The water hardness conditions for the supply water to the dishwasher could be varied, as could the detergent formulation and dosage. The temperature of the supply water was maintained at 120° F.

Four detergent compositions, listed in Table 1, were evaluated containing the copolymers listed in Table 2. The exact test conditions and amount of copolymer added to the detergent compositions are shown in Tables 3–13. Tables 3–5 show the performance results of detergent composition A, Tables 6–8 show the performance results of detergent composition B, Tables 9–11 show the performance results of detergent composition C, and Tables 12 and 13 show the performance results of detergent composition D.

TABLE 1

| Detergent Compositions Tested | |
|---|---|
| A. Zeolite based: | 23% zeolite, 7% sodium silicate, 5% sodium carbonate, 2% bentonite clay, polymer at specified level, diluted to 100% with water. |
| B. Soda Ash based: | 28% sodium carbonate, 7% sodium silicate, 2% bentonite clay, polymer at specified level, diluted to 100% with water. |
| C. Phosphate based: | 23% sodium tripolyphosphate, 7% sodium silicate, 5% sodium carbonate, polymer at specified level, diluted to 100% with water. |
| D. Soda Ash based powder: | Vert Detergent (Consumer product from Canada-Loblaws), contains about 12% $Na_2SO_4$, 16% $H_2O$, some silicate, >40% $Na_2CO_3$, citrate and no phosphate or chlorine. |

TABLE 2

| Example | Polymer Composition (weight percents) | Mw |
|---|---|---|
| 1 (comparative) | AA | 4500 |
| 2 | 53 DIB/47 MAnh | 15000 |
| 3 (comparative) | 65 AA/35 MAnh | 30000 |
| 4 (comparative) | 77 AA/23 AMPS | 4500 |
| 5 (comparative) | 50 MVE/50 MAnh | 20000 |
| 6 (comparative) | 37 MVE/63 MAnh | 40000 |
| 7 (comparative) | 37 MVE/63 MAnh | 50000 |
| 8 (comparative) | 37 MVE/63 MAnh | 70000 |
| 9 (comparative) | 37 MVE/63 MAnh | 20000 |
| 10 (comparative) | 30 AA/70 $C_{16-18}EO_{20}$ | 3600 |
| 11 (comparative) | 30 AA/70 M—$C_{16-18}EO_{20}$ | 2110 |
| 12 (comparative) | 95 AA/5 MAA | 10000 |
| 13 (comparative) | 75 AA/25 MAnh | 7500 |
| 14 (comparative) | NS | 2000 |
| 15 | 59 $C_{10}H_{20}$/41 MAnh | ~17000 |
| 16 | 74 $C_{20}H_{40}$/26 MAnh—$NH_4$+ | ~24000 |
| 17 | 74 $C_{20}H_{40}$/26 MAnh—Na+ | ~24000 |
| 18 (comparative) | 29 AA/35 STY/36 α-MSTY | 8500 |
| 19 (comparative) | AA | 18000 |
| 20 (comparative) | 80 AA/20 MAnh | 15000 |
| 21 (comparative) | 30 AA/70 $C_{12-15}EO_{12}$ | 3500 |
| 22 | 36 IB/64 MAnh | 10000 |
| 23 (comparative) | SSTY/MAnh | 1000 |
| 24 (comparative) | SSTY/MAnh | 3000 |
| 25 (comparative) | 30 AA/70 STY | 9500 |
| 26 | 52 STY/48 MAnh | 1700 |
| 27 | 52 STY/48 MAnh | 1900 |
| 28 (comparative) | MAnh | 1000 |
| 29 (comparative) | 22 Eth/78 MAnh | 134000 |

AA = Acrylic Acid
Eth = Ethylene
DIB = Diisobutylene
AMPS = 2-acrylamido-2-methylpropane sulfonic acid
MAnh = Maleic Anhydride
MVE = Methyl Vinyl Ether
MAA = Methacrylic Acid
STY = Styrene
SSTY = Sulfonated Styrene
IB = Isobutylene
NS = Naphthalene Sulfonate
α-MSTY = α-Methyl Styrene
$C_{16-18}EO_{20}$ = Cetyl, Stearyl alcohol with 20 moles of ethoxylate
M-$C_{16-18}EO_{20}$ = Methylated version of $C_{16-18}EO_{20}$
$C_{12-15}EO_{12}$ = A linear, primary alcohol of 12 to 15 carbons with an average of 12 moles of ethoxylate A. Zeolite Based Detergent - 3 cycles in the dishwasher at 120° F.

TABLE 3[1]

| Silicate[2] Type (7%) | % NaOCl | Surfactant, % | Copolymer of Example 2, % | Final Film | Final Spot | Average Film | Average Spot |
|---|---|---|---|---|---|---|---|
| RU | 1 | — | — | 2 | 1–2 | 1.2 | 1.0 |
| RU | — | — | — | 3–4 | 2–3 | 2.8 | 2.7 |
| Starso | — | — | — | 3 | 3 | 2.7 | 2.3 |
| Meta | — | — | — | 3 | 3–4 | 2.0 | 3.2 |
| RU | — | 2 | — | 2 | 3–4 | 1.0 | 2.8 |
| RU | — | — | 7 | 1 | 0–1 | 0.7 | 0.3 |
| RU | — | 2 | 7 | 1 | 0–1 | 0.5 | 0.3 |
| Starso | — | 2 | 7 | 0 | 0 | 0 | 0 |
| Meta | — | 2 | 7 | 1 | 0 | 0.5 | 0 |
| Palmolive Automatic (Colgate)[3] | | | — | 1 | 0 | 0.7 | 0 |

[1]Conditions: Normal Wash, 0.7% detergent, 40 grams soil, 200 ppm hard water.
[2]RU silicate = 2.4:1.0 $SiO_2/Na_2O$
Starso silicate = 1.8:1.0 $SiO_2/Na_2O$
Meta silicate = 1.0:1.0 $SiO_2/Na_2O$
[3]Palmolive Automatic detergent is a phosphate based automatic dishwasher detergent containing hypochlorite.

TABLE 4[1]

| Polymer of Example | @ X% | % NaOCl | Surfactant, % | Final Film | Final Spot | Average Film | Average Spot |
|---|---|---|---|---|---|---|---|
| — | | 1 | — | 2 | 1 | 1.5 | 0.7 |
| — | | — | — | 2 | 4 | 1.5 | 3.7 |
| — | | — | 2 | 1–2 | 4 | 1.0 | 3.2 |
| 2 | 7 | — | — | 0–1 | 2 | 0.3 | 1.2 |
| 2 | 3 | — | 2 | 0–1 | 2 | 0.2 | 1.7 |
| 2 | 5 | — | 2 | 0–1 | 0 | 0.2 | 0 |
| 2 | 7 | — | 2 | 0–1 | 0–1 | 0.1 | 0.3 |
| 2 | 7 | — | 2 | 0–1 | 0 | 0.3 | 0.1 |
| 15 | 5 | — | 2 | 0–1 | 0 | 0.2 | 0 |
| 12 | 2 | — | 2 | 2 | 4 | 1.0 | 3.4 |
| 11 | 7 | — | 2 | 1–2 | 2–3 | 0.8 | 1.8 |
| 11 | 7 | — | — | 1 | 3 | 1.0 | 1.9 |
| 5 | 7 | — | 2 | 1 | 4 | 0.3 | 2.7 |
| 9 | 7 | — | — | 3 | 2–3 | 2.0 | 1.9 |
| 10 | 7 | — | 2 | 1 | 1–2 | 0.8 | 1.3 |
| 10 | 7 | — | — | 1–2 | 3–4 | 0.8 | 2.5 |
| 1 | 7 | — | 2 | 1–2 | 2–3 | 0.8 | 2.3 |
| 4 | 7 | — | 2 | 1 | 4 | 0.7 | 3.0 |

TABLE 4[1]—continued

| Polymer of Example | @ X% | % NaOCl | Surfactant, % | Final Film | Final Spot | Average Film | Average Spot |
|---|---|---|---|---|---|---|---|
| 12 | 7 | — | 2 | 1-2 | 4 | 0.9 | 3.3 |
| 3 | 7 | — | 2 | 1 | 4 | 1.0 | 3.5 |
| Palmolive Automatic (Colgate) | | | | 0-1 | 0-1 | 0.3 | 0.4 |
| Amway Powder @ 0.35%[2] | | | | 0-1 | 0 | 0.2 | 0 |

[1]Conditions: Normal wash, 0.45% detergent, 40 grams soil, 120 ppm hard water.
[2]Amway powder is a concentrated high phosphate, powdered dishwashing detergent containing an available chlorine source and a defoaming surfactant.

B. Soda Ash Based Detergent - 3 cycles in the dishwasher at 120° F.

TABLE 6[1]

| Polymer of Example | @ X% | % NaOCl | Surfactant, % | Final Film | Final Spot | Average Film | Average Spot |
|---|---|---|---|---|---|---|---|
| — | | 1 | — | 4 | 0 | 2.8 | 0 |
| 2 | 5 | — | 2 | 3-4 | 0 | 2.3 | 0 |
| 15 | 5 | — | 2 | 3 | 0 | 2.3 | 0 |
| 7[2] | 5 | — | 2 | 3 | 0 | 2.0 | 0 |

[1]Conditions: Normal wash, 0.7% detergent, 40 grams soil, 200 ppm hard water.

TABLE 7[1]

| Polymer of Example | @ X% | % NaOCl | Surfactant, % | Final Film | Final Spot | Average Film | Average Spot | $CaCO_3$ |
|---|---|---|---|---|---|---|---|---|
| — | | 1 | — | 4+ | 1-2 | 2.8 | 1.2 | H[2] |
| — | | — | 2 | 4 | 2-3 | 2.3 | 2.2 | H |
| — | | — | 7 | 2 | 3 | 1.2 | 2.5 | SM |
| 2 | 7 | — | — | 1-2 | 2-3 | 0.6 | 1.3 | S |
| 2 | 3 | — | 1 | 3 | 0 | 2.3 | 0 | M |
| 2 | 3 | — | 2 | 2-3 | 0 | 1.6 | 0 | M |
| 2 | 5 | — | 2 | 0-1 | 0-1 | 0.2 | 0.5 | N |
| 2 | 7 | — | 2 | 0-1 | 0-1 | 0.3 | 0.4 | N |
| 5 | 5 | — | 2 | 1 | 4 | 0.7 | 3.6 | S |
| 6 | 5 | — | 2 | 1 | 4 | 0.7 | 3.0 | S |
| 7 | 5 | — | 2 | 2 | 4 | 1.3 | 2.5 | SM |
| 8 | 5 | — | 2 | 2 | 4 | 1.7 | 3.0 | SM |
| 13 | 5 | — | 2 | 3 | 2 | 2.0 | 2.0 | M |
| 14 | 5 | — | 2 | 1-3 | 0 | 1.7 | 0 | SM |
| 18 | 5 | — | 2 | 3 | 0 | 2.0 | 0 | SM |
| 15 | 5 | — | 2 | 2 | 0 | 1.7 | 0 | N |
| 16 | 5 | — | 2 | 4 | 4 | 2.7 | 2.7 | N |
| 17 | 5 | — | 2 | 3 | 4 | 1.3 | 2.7 | N |
| 29 | 5 | — | 2 | 2 | 3-4 | 1.7 | 3.0 | N |
| 23 | 5 | — | 2 | 3 | 3 | 1.7 | 3.0 | M |
| 24 | 5 | — | 2 | 3 | 1 | 2.0 | 1.0 | M |
| 26 | 5 | — | 2 | 2 | 0 | 1.0 | 0 | S |
| 25 | 5 | — | 2 | 2 | 0 | 1.0 | 0 | SM |
| 27 | 5 | — | 2 | 4 | 0 | 3.0 | 0 | M |
| 28 | 5 | — | 2 | 2 | 3-4 | 1.3 | 3.2 | N |
| 30 | 5 | — | 2 | 2 | 4 | 1.0 | 3.0 | N |

[1]Conditions: Normal wash, 0.45% detergent, 40 grams soil, 120 ppm hard water.
[2]H = heavy deposit of $CaCO_3$, M = medium deposit, S = slight deposit, N = no deposit.

TABLE 8*

| Polymer of Example | @ X% | % NaOCl | Surfactant, % | Final Film | Final Spot | Average Film | Average Spot | $CaCO_3$ |
|---|---|---|---|---|---|---|---|---|
| — | | 1 | — | 4 | 1-2 | 2.7 | 1.8 | H |
| — | | — | 7 | 2-3 | 1-2 | 2.0 | 1.8 | M |
| 2 | 7 | — | — | 1 | 3-4 | 0.8 | 1.7 | S |
| 2 | 5 | — | 2 | 0-1 | 0-1 | 0.3 | 0.3 | N |
| 2 | 7 | — | 2 | 1 | 1-2 | 0.7 | 1.0 | N |
| 8 | 7 | — | 2 | 1 | 4 | 0.8 | 3.5 | S |

*Conditions: Light wash, 0.9% detergent, 30 grams soil, 120 ppm hard water.

TABLE 5*

| Silicate Type (7%) | % NaOCl | Surfactant, % | Polymer of Example 2, % | Final Film | Final Spot | Average Film | Average Spot |
|---|---|---|---|---|---|---|---|
| RU | 1 | — | — | 0 | 2 | 0 | 1.0 |
| RU | — | — | — | 3 | 3-4 | 2.2 | 2.8 |
| RU | — | 2 | — | 2-3 | 3-4 | 1.8 | 3.3 |
| RU | — | — | 7 | 0 | 1-2 | 0 | 1.2 |
| RU | — | 2 | 5 | 0-1 | 1-2 | 0.3 | 1.0 |
| RU | — | 2 | 7 | 0-1 | 1 | 0.3 | 0.7 |
| Starso | — | 2 | 7 | 0-1 | 1-2 | 0.2 | 0.8 |
| Meta | — | 2 | 7 | 0-1 | 2 | 0.2 | 1.0 |
| Palmolive Automatic (Colgate) | | | — | 0-1 | 1 | 0.4 | 0.3 |
| Amway Powder @ 0.7% | | | — | 0-1 | 1-2 | 0.4 | 0.7 |

[1]Conditions: Light wash, 0.9% detergent, 30 grams soil, 120 ppm hard water.

C. Phosphate Based Detergents - 3 cycles in the dishwasher at 120° F.

TABLE 9*

| Silicate Type (7%) | % NaOCl | Surfactant, % | Polymer of Example 2, % | Final Film | Final Spot | Average Film | Average Spot |
|---|---|---|---|---|---|---|---|
| RU | 1 | — | — | 0 | 0-1 | 0 | 0.6 |
| RU | — | — | — | 1 | 4+ | 1.0 | 3.8 |
| RU | — | 2 | — | 0-1 | 4 | 0.3 | 3.1 |
| Starso | — | 2 | — | 2 | 3-4 | 1.3 | 3.2 |
| Meta | — | 2 | — | 1-2 | 3-4 | 1.0 | 2.8 |
| RU | — | — | 3 | 0-1 | 1-3 | 0.5 | 1.3 |
| RU | — | — | 5 | 0-1 | 0 | 0.3 | 0.1 |
| Starso | — | — | 5 | 0-1 | 1-2 | 0.3 | 0.7 |
| Meta | — | — | 5 | 0-1 | 1-2 | 0.3 | 0.9 |
| RU | — | — | 7 | 0-1 | 0 | 0.5 | 0 |
| RU | — | 2 | 3 | 0-1 | 0 | 0.5 | 0 |

TABLE 9*-continued

| Silicate Type (7%) | % NaOCl | Surfactant, % | Polymer of Example 2, % | Final Film | Final Spot | Average Film | Average Spot |
|---|---|---|---|---|---|---|---|
| RU | — | 2 | 5 | 0–1 | 0 | 0.5 | 0 |

*Conditions: Normal wash, 0.7% detergent, 40 grams soil, 200 ppm hard water.

TABLE 10*

| Polymer of Example | @ X% | % NaOCl | Surfactant, % | Final Film | Final Spot | Average Film | Average Spot |
|---|---|---|---|---|---|---|---|
| — | | 1 | — | 0 | 0–1 | 0 | 0.2 |
| — | | — | — | 1 | 4 | 0.5 | 3.3 |
| — | | — | 2 | 1 | 3–4 | 0.3 | 3.1 |
| 2 | 7 | — | — | 0 | 2 | 0 | 1.2 |
| 2 | 3 | — | 2 | 1 | 1–2 | 0.5 | 0.8 |
| 2 | 5 | — | 2 | 0–1 | 0–1 | 0.3 | 0.7 |
| 2 | 7 | — | 2 | 0–1 | 0–1 | 0.3 | 0.5 |
| 5 | 7 | — | 2 | 0–1 | 3–4 | 0.2 | 2.8 |
| 9 | 7 | — | — | 1 | 3–4 | 0.2 | 2.8 |
| 11 | 7 | — | 2 | 0–1 | 2–3 | 0.3 | 2.1 |
| 11 | 7 | — | — | 1 | 3–4 | 0.8 | 2.6 |
| 10 | 7 | — | 2 | 0 | 2–3 | 0 | 1.9 |
| 10 | 7 | — | — | 0 | 2–3 | 0 | 1.9 |
| 1 | 7 | — | 2 | 0 | 3 | 0 | 2.3 |
| 4 | 7 | — | 2 | 0–1 | 3–4 | 0.2 | 3.0 |
| 12 | 7 | — | 2 | 0–1 | 4 | 0.2 | 3.5 |
| 3 | 7 | — | 2 | 1 | 4 | 0.5 | 3.5 |

*Conditions: Normal wash, 0.45% detergent, 40 grams soil, 120 ppm hard water.

TABLE 11*

| Silicate Type (7%) | % NaOCl | Surfactant, % | Polymer of Example 2, % | Final Film | Final Spot | Average Film | Average Spot |
|---|---|---|---|---|---|---|---|
| RU | 1 | — | — | 3 | 3–4 | 1.7 | 2.7 |
| RU | — | — | — | 4 | 4 | 3.0 | 3.7 |
| RU | — | 2 | — | 2 | 2–3 | 1.7 | 2.4 |
| RU | — | — | 5 | 0–1 | 2–3 | 0.2 | 1.5 |
| RU | — | — | 7 | 0–1 | 2–3 | 0.2 | 1.8 |
| RU | — | 2 | 5 | 0–1 | 3–4 | 0.3 | 2.4 |
| RU | — | 2 | 7 | 0–1 | 1–2 | 0.3 | 1.6 |
| Palmolive Automatic (Colgate) | | | — | 0–1 | 1–2 | 0.3 | 0.7 |

*Conditions: Light wash, 0.9% detergent, 30 grams soil, 120 ppm hard water.

D. Soda Ash Based Powder (Vert detergent-Loblaws) - 3 cycles in the dishwasher at 120° F.

TABLE 12*

| Polymer of Example | @ X% | Final Film | Final Spot | Average Film | Average Spot |
|---|---|---|---|---|---|
| — | | 1 | 3.3 | 0.7 | 2.9 |
| Cascade (Procter & Gamble Co.) | | 0 | 0.3 | 0 | 0.3 |
| 1 | 2 | 0.5 | 3 | 0.5 | 1.3 |
| 1 | 5 | 0.5 | 3 | 0.5 | 2.3 |
| 19 | 2 | 0 | 3 | 0 | 2.0 |
| 20 | 2 | 1 | 4 | 0.5 | 3.0 |
| 21 | 2 | 1.5 | 4 | 0.5 | 3.0 |
| 2 | 2 | 0.5 | 1.5 | 0.3 | 0.8 |
| 2 | 2.5 | 2 | 0 | 1.0 | 0 |
| 2 | 3 | 0.5 | 0 | 0.5 | 0 |
| 2 | 4 | 0.5 | 0 | 0.1 | 0 |

*Conditions: Normal wash, 0.7% detergent, 40 grams soil, 200 ppm hard water.

TABLE 13*

| Polymer of Example | @ X% | Final Film | Final Spot | Average Film | Average Spot |
|---|---|---|---|---|---|
| 29 | 2 | 2.8 | 1.5 | 1.6 | 1.2 |
| 5 | 2 | 2.5 | 3.8 | 1.9 | 3.0 |

TABLE 13*-continued

| Polymer of Example | @ X% | Final Film | Final Spot | Average Film | Average Spot |
|---|---|---|---|---|---|
| 28 | 2 | 3.1 | 3.6 | 2.4 | 2.5 |
| 2 | 2 | 2 | 2 | 0.8 | 1.3 |
| 24 | 2 | 3 | 3.8 | 1.8 | 2.6 |
| 22 | 2 | 2 | 0.5 | 1.3 | 0.5 |

*Conditions: Normal wash, 0.7% detergent, 40 grams soil, 200 ppm hard water.

We claim:

1. A machine dishwashing detergent composition consisting of:

(a) from about 0.5 to 10 percent by weight of a copolymer containing as polymerized units from 20 to 75% by weight of the copolymer of maleic acid, maleic anhydride, or salts thereof and from 25 to 80% by weight of the copolymer of a hydrophobe, wherein the hydrophobe is at least one monomer selected from the group consisting of isobutylene, diisobutylene, styrene, decene and eicosene;

(b) from 0 to about 90 percent by weight of an alkaline builder selected from the group consisting of alkali metal polyphosphates, alkali metal carbonates, alkali metal borates, alkali metal hydroxides, alkali metal bicarbonates, alkali metal citrates, alkali metal carboxylates and alkali metal polycarboxylates;

(c) from 0 to about 50 percent of an alkali metal silicate;

(d) from 0 to about 40 percent of a zeolite;

(e) from 0 to about 5 percent by weight of a stabilizer;

(f) from 0 to about 10 percent by weight of surfactant selected from the group consisting of anionic, nonionic, zwitterionic, and amphoteric surfactants and combinations thereof as the only surfactants present; and (g) from 0 to about 5 percent by weight of other conventional adjuvants selected from the group consisting of perfumes, colorants, bacterial agents, and viscosity modifiers;

wherein the sum of the percentages of a, b, c, d, e, f, and g is equal to 100 percent, and wherein said composition is substantially free of chlorine.

2. The chlorine-free machine dishwashing detergent composition of claim 1 wherein the copolymer concentration is from about 2 to 7 percent by weight.

3. The chlorine-free machine dishwashing detergent composition of claim 1 wherein the hydrophobe is diisobutylene.

4. The chlorine-free machine dishwashing detergent composition of claim 1 wherein the copolymer contains as polymerized units from 25 to 70% by weight of the copolymer of maleic acid, maleic anhydride, or the salts thereof, and from 30 to 75% by weight of the copolymer of the hydrophobe.

5. The chlorine-free machine dishwashing detergent composition of claim 1 wherein the alkaline builder concentration is from about 20 to 90 percent by weight.

6. The chlorine-free machine dishwashing detergent composition of claim 1 wherein the silicate concentration is from about 1 to 10 percent by weight.

7. The chlorine-free machine dishwashing detergent composition of claim 1 wherein the zeolite concentration is from about 20 to 40 percent by weight.

8. The chlorine-free machine dishwashing detergent composition of claim 1 wherein the surfactant concentration is from about 1 to 5 percent by weight.

9. A process of washing food soiled utensils in a machine dishwasher comprising contacting said utensils with an aqueous solution of about 0.2 to 1.5 percent by weight of the detergent composition of claim 1 at a water temperature of about 80° F. to about 140° F.

10. The process of claim 9 wherein the copolymer concentration in the detergent composition is from about 2 to 7 percent by weight.

11. The process of claim 9 wherein the hydrophobe is diisobutylene.

12. The process of claim 9 wherein the copolymer contains as polymerized units from 25 to 70% by weight of the copolymer of maleic acid, maleic anhydride or the salt thereof and from 30 to 75% by weight of the copolymer of the hydrophobe.

13. The process of claim 9 wherein the alkaline builder concentration in the detergent composition is from about 20 to 90 percent by weight.

14. The process of claim 9 wherein the silicate concentration in the detergent composition is from about 1 to 10 percent by weight.

15. The process of claim 9 wherein the zeolite concentration in the detergent composition is from about 20 to 40 percent by weight.

16. The process of claim 9 wherein the surfactant concentration in the detergent composition is from about 1 to 5 percent by weight.

17. The process of claim 9 wherein the detergent concentration in the aqueous solution is from about 0.4 to 1 percent by weight of the detergent.

18. The process of claim 9 wherein the temperature is from about 100° F. to 125° F.

* * * * *